US006070920A

United States Patent [19]

Ryan

[11] Patent Number: 6,070,920

[45] Date of Patent: Jun. 6, 2000

[54] CENTER LOCKING DEVICE FOR RAIL CAR PLUG TYPE DOORS

[75] Inventor: Walter S. Ryan, Mercer, Pa.

[73] Assignee: Pennsylvania Rail Car Company, Mercer, Pa.

[21] Appl. No.: 09/195,403

[22] Filed: Nov. 19, 1998

Related U.S. Application Data

[63] Continuation-in-part of application No. 08/848,896, May 1, 1997, abandoned.

[51] Int. Cl.[7] ..... E05B 39/02

[52] U.S. Cl. ..... 292/205; 292/286

[58] Field of Search ..... 292/202, 281, 292/285, 286, 282, 205

[56] References Cited

U.S. PATENT DOCUMENTS

| | | | |
|---|---|---|---|
| 270,874 | 6/1883 | Brooks | 292/281 |
| 2,196,294 | 4/1940 | Dwyer | 292/281 |
| 3,683,552 | 8/1972 | Bollinger, Sr. . | |
| 3,776,581 | 12/1973 | Ross, Jr. . | |
| 3,933,384 | 1/1976 | Schuller et al. . | |
| 4,098,022 | 7/1978 | Hesch . | |
| 5,467,558 | 11/1995 | Kober et al. . | |

*Primary Examiner*—B. Dayoan
*Assistant Examiner*—Gary Estremsk
*Attorney, Agent, or Firm*—Harpman & Harpman

[57] ABSTRACT

A lock for railway car sliding doors of the plug type that secures the center bottom edge of the door against unintentional outward movement caused by accidental impact from within the car. The lock is secured to the rail car surface adjacent the bottom edge of the door and is pivoted into door engagement on the center bottom of the door.

5 Claims, 4 Drawing Sheets

CENTER LOCKING DEVICE FOR RAIL CAR PLUG TYPE DOORS

This is a CIP patent application of Ser. No. 08/848,896, filed May 1, 1997 now abandoned.

BACKGROUND OF THE INVENTION

1. Technical Field

This device relates to rail car doors that are pivoted and slide transversely of the car wall out of the door opening.

2. Description of Prior Art

Prior art devices of this type have been directed to securing plug type railway car doors within the door opening by using pivotal crank rod assemblies which support the door and a variety of engagement rods that are advanced by a central locking assembly for engagement with apertured lugs on the rail car securing the door thereagainst, see for example U.S. Pat. Nos. 3,683,552, 3,776,581, 3,933,384, 4,098,022 and 5,467,558.

In U.S. Pat. No. 3,683,552, a plug door control mechanism is disclosed wherein the door is held in spaced relation from the car when the door is being moved.

U.S. Pat. No. 3,776,581 a tamper indicating latch on the center bottom portion of a railway car is shown.

U.S. Pat. No. 3,933,384 discloses an anti-pilfering locking device of a hasp configuration.

U.S. Pat. No. 4,098,022 is directed to a plug sliding rail car door having vertical edge beams that react with the door parts to center the door within the door opening for securing purposes.

U.S. Pat. No. 5,467,558 shows a rail car plug door having multiple locking bars that are extended and retracted on the door from a central activation mechanism. The locking rods provide limited retaining force on the door to maintain compression of the door gaskets to seal the door within the opening.

SUMMARY OF THE INVENTION

A center bottom edge locking device for railway plug doors that are pivoted into sealing relation in the door opening of the railway car. Doors of this type traditionally have cranks for compression of the door gaskets that provide a weatherproof seal for the door. The doors are in pairs located on oppositely disposed sides of the rail car with one pair usually remaining closed as the car is loaded and unloaded by forklift type trucks that maneuver within the cars. Oftentimes during this process, the forklift trucks occasionally engage the closed door pair, typically pushing and bending the doors away from their sealed closed position.

It is the object of this invention to provide an independent engagement device that restricts transverse movement of the door away from sealing relationship of the car door opening. The device of the invention selectively extends an engagement arm against the reinforcing element attached to the door with a tamper evident acceptable element retractable therewith.

DESCRIPTION OF THE PREFERRED EMBODIMENT

Figure 1:
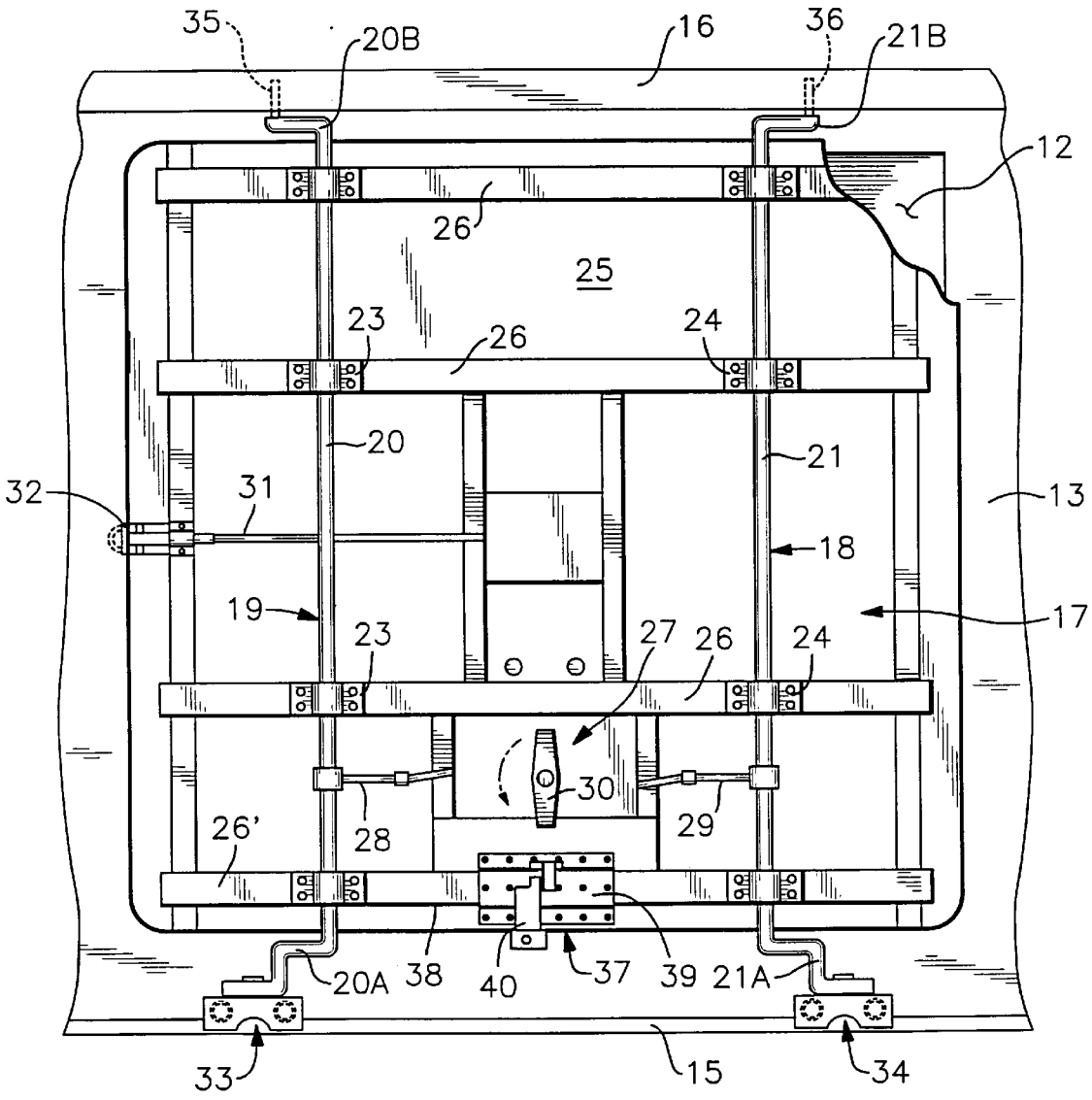
FIG. 1 is a side elevational view of one door of a sliding plug railway door with portions broken away for illustration purposes.

Referring to FIG. 1 of the drawings, a rail car 10 can be seen having a door opening 12 and a sidewall 13 with a plug door assembly 14 in sealing relation positioned thereon. The rail car 10 also has door rails 15 and 16 that are respectively positioned above and below the door opening 12. A door 17 is supported by a pair of crank rod assemblies 18 and 19 having crank rods 20 and 21 rotatably secured to the door 17 by pairs of rod engagement fittings 23 and 24 as will be well known and understood by those skilled in the art. Typically, the door 17 has a front surface panel 25 with a plurality of horizontal stiffeners 26 extending thereacross. A door latching assembly 27 has door crank engagement rods 28 and 29 with a handle 30 extending therefrom. An auxiliary locking rod 31 is actuated by the door latch assembly and is engageable within a lock post bracket 32 on the rail car.

The crank rods 20 and 21 have bottom cranks 20A and 21A with respective wheel hanger assemblies 33 and 34 movable on the bottom door rail 15 and upper cranks 20B and 21B with interengaging track elements 35 and 36 within the upper door rail 16, again which is well understood by those skilled in the art of plug door manufacturing and design.

A center door lock assembly 37 of the invention can be seen in FIG. 1 of the drawings positioned adjacent a bottom door edge 38 of the door 17 centered thereon. The door lock assembly 37 has a reinforcing engagement plate 39 and a movable door bolt 40.

Figure 2:
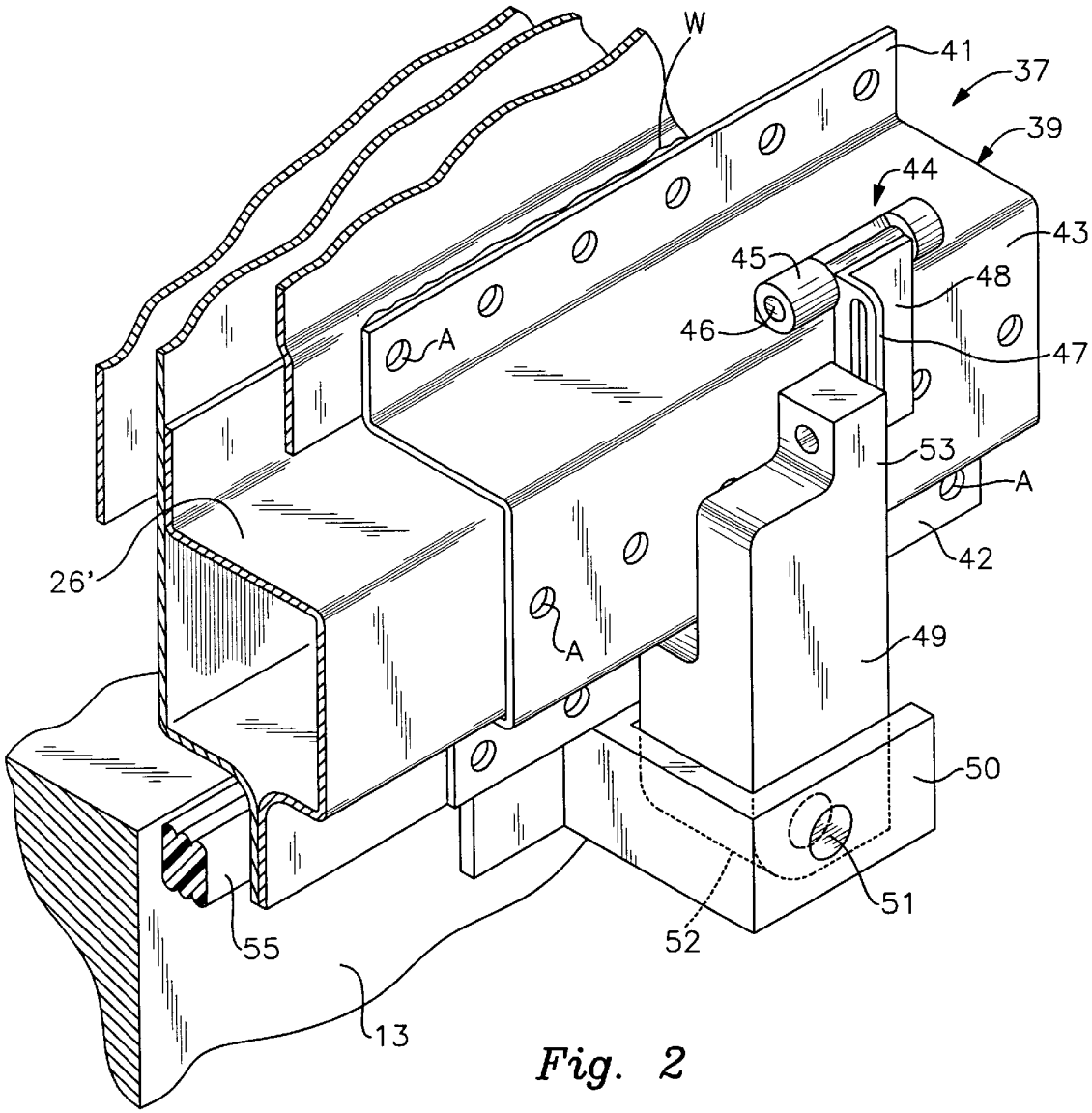
FIG. 2 is a perspective view of the locking assembly of the invention on a door with parts broken away.
Figure 3:
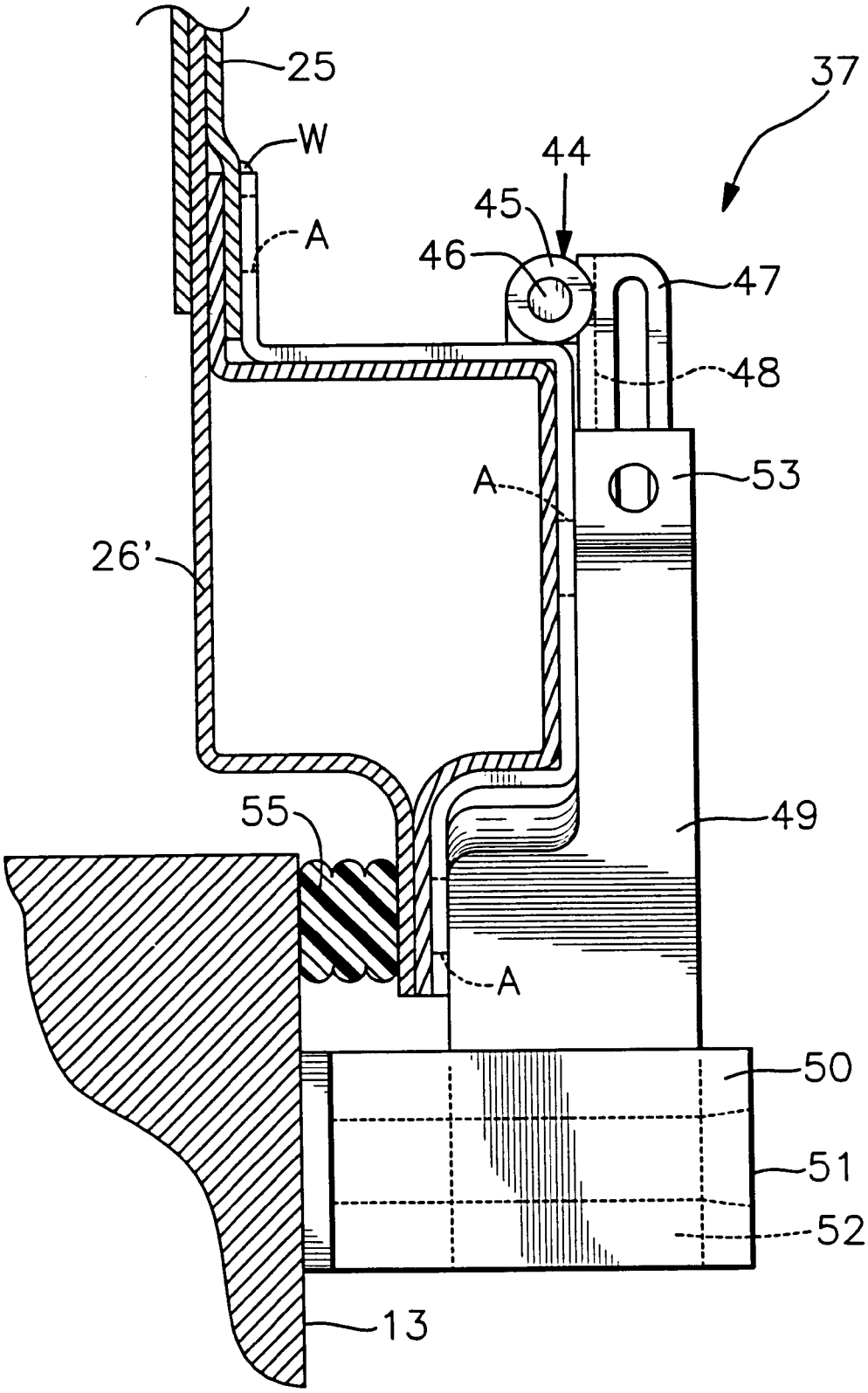
FIG. 3 is a partial cross-sectional view of the invention as generally illustrated in FIG. 2 of the drawings.
Figure 4:
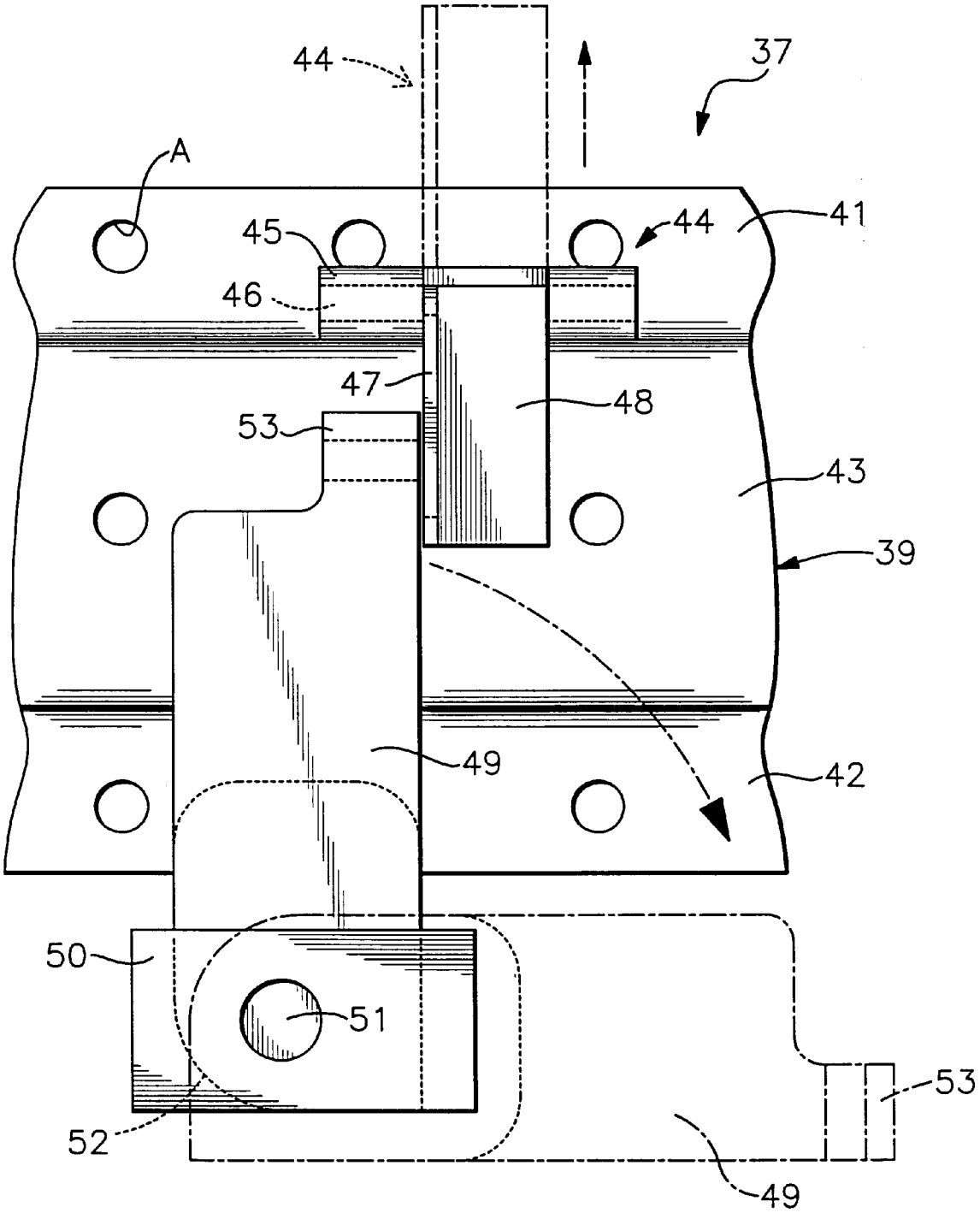
FIG. 4 is a side elevation of the door lock assembly of the invention with elements in unlock position shown in broken lines.

Referring now to FIGS. 2, 3 and 4 of the drawings, the door lock assembly 37 can be seen wherein the reinforcing engagement plate 39 is generally rectangular having oppositely disposed elongated mounting flanges 41 and 42 with an elongated upstanding offset central portion 43 positioned therebetween. The reinforcing plate 39 is so formed so as to be engageable over a bottom stiffening element 26'. The flanges 41 and 42 and upstanding center portion 43 have a plurality of longitudinally spaced apertures A therein.

The apertures A in the upstanding center portion 43 are used as drilling guides in the bottom edge of the door as will be described in greater detail hereinafter.

The apertures A in the flanges 41 and 42 are used to provide spacing engagement openings over existing fabrication bolts of the door structure. The respective mounting flanges 41 and 42 are welded to the stiffening elements 26' at their edge securing the engagement plates 39 thereto.

A tamper evident sealing assembly 44 is secured to the upstanding center portion 43 and has a slotted mounting sleeve 45 with a rotatable center pin 46 within. An apertured flange 47 extends from a support tab 48 which is welded to the center pin 46 through the slotted sleeve 45 so as to be movable as seen in broken lines in FIG. 3 of the drawings. The door lock assembly 37 has a bolt element 49 pivotally secured within a mounting frame 50 by a pivot pin 51. The bolt element 49 is of a generally rectangular shape having a rounded off pivot end 52 and an oppositely disposed apertured end tab 53 extending therefrom.

The mounting frame 50 is open to allow for pivoting movement of the bolt element 49 from an upright lock position as illustrated in FIGS. 2 and 3 of the drawings to a 90 degree horizontally disposed unlocked position as shown in broken lines in FIG. 4 of the drawings. The mounting frame 50 is secured to the rail car sidewall 13 adjacent the bottom door edge 37 by welding centered thereon and in respect to the engagement reinforcing plate 39 as hereinbefore disclosed.

It will be apparent that the tamper evident sealing assembly 44 provides for a removable sealing strip (not shown) to be positioned through the apertured tab 53 and flange 47 when in upright door engagement position as best seen in FIG. 4 of the drawings and thus serves as a tamper evident indication that the door has been opened since the seal would have to be removed before the door could be open.

In operation, once the rail car door 17 has been closed and sealed, the center door lock assembly 37 of the invention can be engaged by moving the bolt element 49 to the upright vertical position and the support tab 48 of the tamper evident sealing assembly 45 is flipped down as seen in FIGS. 2, 3, and 4 of the drawings preventing the bolt element 49 from being disengaged from the engagement with the reinforcing plate 39 on the bottom of the door 17. The movable bolt element 49 thereby prevents accidental disengagement of the door 17 from the closed sealing position as seen in FIG. 3 of the drawings wherein the door gaskets 55 are compressed by engagement of the door 17 against the rail car 10 maintaining a waterproof seal therebetween.

It will thus be seen that a new and novel auxiliary locking and restraint device for rail car doors has been illustrated and described and it will be apparent to those skilled in the art that various changes and modifications may be made therein without departing from the spirit of the invention.

Therefore I claim:

1. An auxiliary locking and restraint device for use on a railroad rail car having a plug door, said locking and restraint device comprising:

a reinforcing plate having means for mounting onto a central planar portion of the bottom edge of the outer surface of the door, said reinforcing plate having a sealing tab pivotally mounted thereon, said sealing tab constrained to pivotal movement in a plane substantially perpendicular to that of said reinforcing plate, said sealing tab having an aperture therethrough that is substantially parallel to its pivotal axis, a mounting frame adjacent to said reinforcing plate, said mounting frame being adapted to be mounted on an outer surface of the rail car that is parallel to the outer surface of the door, a bolt element pivotally mounted to said mounting frame and constrained to movement within a plane that is substantially parallel to that of said reinforcing plate, said bolt element's pivotal axis being perpendicular to said pivotal axis of said sealing tab, said bolt element having an aperture therethrough that is substantially perpendicular to its pivotal axis, whereby when said mounting frame and said reinforcing plate are mounted on the rail car and its door is in a fully closed position, said bolt element can be swung parallel to the door's outer surface, up into a vertical position that blocks outward movement of the door and said sealing tab can be swung perpendicular to the door's outer surface, down to a vertical position that blocks pivotal movement of said bolt element and said apertures of said sealing tab and said bolt element are adjacent and axially aligned for receiving a seal therethrough.

2. The locking and restraint device of claim 1 wherein said bolt element has a curved lower edge portion adjacent its pivot axis, said pivot axis being defined by a pivot pin and said aperture being in an oppositely disposed tab portion of the bolt element.

3. The locking and restraint device of claim 1 wherein said reinforcing plate has a pair of elongated oppositely disposed offset mounting tabs.

4. The locking and restraint device of claim 1 wherein said means for mounting said reinforcing plate to said door comprises; a welded portion joining said mounting tabs to said door.

5. The auxiliary locking and restraint device of claim 1 wherein said sealing tab is mounted to said reinforcing plate by a slotted mounting sleeve having a support pin therein, and said sealing tab aperture is in a flange portion that extends from said slotted mounting sleeve.

* * * * *